United States Patent [19]

Yamamoto et al.

[11] Patent Number: 4,549,681

[45] Date of Patent: Oct. 29, 1985

[54] POWER-DRIVEN TACKER WITH SAFETY DEVICE

[75] Inventors: Kunio Yamamoto; Kaoru Ichikawa; Seki Moriguchi, all of Katsuta, Japan

[73] Assignee: Hitachi Koki Company, Ltd., Tokyo, Japan

[21] Appl. No.: 656,368

[22] Filed: Oct. 1, 1984

[30] Foreign Application Priority Data

Oct. 1, 1983 [JP] Japan ..... 58-152982[U]

[51] Int. Cl.[4] ..... B21J 15/28; B27F 7/17; B25C 5/02

[52] U.S. Cl. ..... 227/8; 227/123

[58] Field of Search ..... 227/6, 8, 123, 130

[56] References Cited

U.S. PATENT DOCUMENTS

| | | | |
|---|---|---|---|
| 2,775,764 | 1/1957 | Maynard | 227/173 |
| 3,273,777 | 9/1966 | Juilfs et al. | 227/123 |
| 3,301,456 | 1/1967 | Schafroth et al. | 227/120 |
| 3,853,257 | 12/1974 | Perkins | 227/123 |
| 3,858,780 | 1/1975 | Perkins et al. | 227/8 |
| 3,905,535 | 9/1975 | Novak et al. | 227/120 |
| 4,139,137 | 2/1979 | Gupta | 227/123 |
| 4,197,974 | 4/1980 | Morton et al. | 227/130 X |
| 4,200,215 | 4/1980 | Novak et al. | 227/123 |
| 4,467,952 | 8/1984 | Morrell, Jr. | 227/123 |

*Primary Examiner*—Paul A. Bell
*Assistant Examiner*—Taylor J. Ross
*Attorney, Agent, or Firm*—Cushman, Darby & Cushman

[57] ABSTRACT

A power-driven hand-held fastener driving machine includes a housing including a reciprocally movable blade, a magazine for carrying a strip of fasteners such as staples, and a guide assembly composed of first and second guides defining a drive track therebetween. A safety device is actuatable in response to being pressed against a workpiece for depressing a switch means to move the blade for driving fasteners one at a time into the workpiece. The safety device is composed of first and second separate members, the first member being engageable with the switch means and the second member being angularly movable into and out of engagement with the first member and engageable with the workpiece. When the second member is out of engagement with the first member, the first member will not actuate the switch means to prevent accidental driving of the blade. A guide locking device keeps the first and second guides together, and, when unlocked, allows the second guide to be angularly moved away from the first guide to open the drive track.

5 Claims, 6 Drawing Figures

POWER-DRIVEN TACKER WITH SAFETY DEVICE

BACKGROUND OF THE INVENTION

The present invention relates to a power-driven hand-held fastener driving machine such as a tacker, and more particularly to a safety device on such a fastener driving machine.

One known safety device for fastener driving machines is disclosd in U.S. Pat. No. 3,905,535. The disclosed safety device includes a linkage which actuates a control valve assembly in response to engagement of a linkage end with a workpiece. The illustrated fastener driving machine also has a quick release assembly for obtaining access to a drive track as when removing a staple jam. While the quick release assembly is actuated to open the drive track to remove a jammed staple, however, the operator tends to touch the linkage end for thereby tripping the control valve assembly. This is dangerous expecially when the operator happens to touch a trigger.

Other forms of drive track access mechanisms are disclosed in U.S. Pat. Nos. 3,273,777, 4,139,137, and 4,200,215. However, the revealed drive track access mechanisms have proven unsatisfactory in that they are relatively complex in structure and cannot easily be actuated.

SUMMARY OF THE INVENTION

It is an object of the present invention to provide a power-driven fastener driving machine having a safety device for reliably disabling a fastener driving blade for protection against accidental injury to the user at the time a drive track is accessed as for jam removal.

Another object of the present invention is to provide a power-driven fastener driving machine having a guide assembly defining a drive track and a guide locking device for easily releasing the guide assembly to open the drive track.

According to the present invention, a safety device for a power-driven fastener driving machine is composed of first and second separate members, the first member being movably mounted on a machine housing for engaging a switch means for actuating a reciprocally movable blade, a first spring acting between the housing and the first member for normally urging the first member away from the switch means, a second member movably mounted on a second guide of a guide assembly and engageable with the first member when the second guide is away from a first guide of the guide assembly, and a second spring acting between the housing and the second member for normally urging the second member to keep a distal end thereof projecting beyond said the second guide. When the distal end of the second member is pressed against a workpiece at the time the second guide is combined with the first guide, the second member engages the first member to cause the first member to actuate the switch means. When the second guide is away from the first guide, the second member is kept out of engagement with the first member. The fastener driving machine includes a guide locking deivce mounted on the second guide for locking the first and second guide together and easily releasing them to open a drive track therebetween.

BRIEF DESCRIPTION OF THE DRAWINGS

The present invention will be described in detail by way of illustrative example with reference to the accompanying drawings, in which.

DETAILED DESCRIPTION

Figure 1:
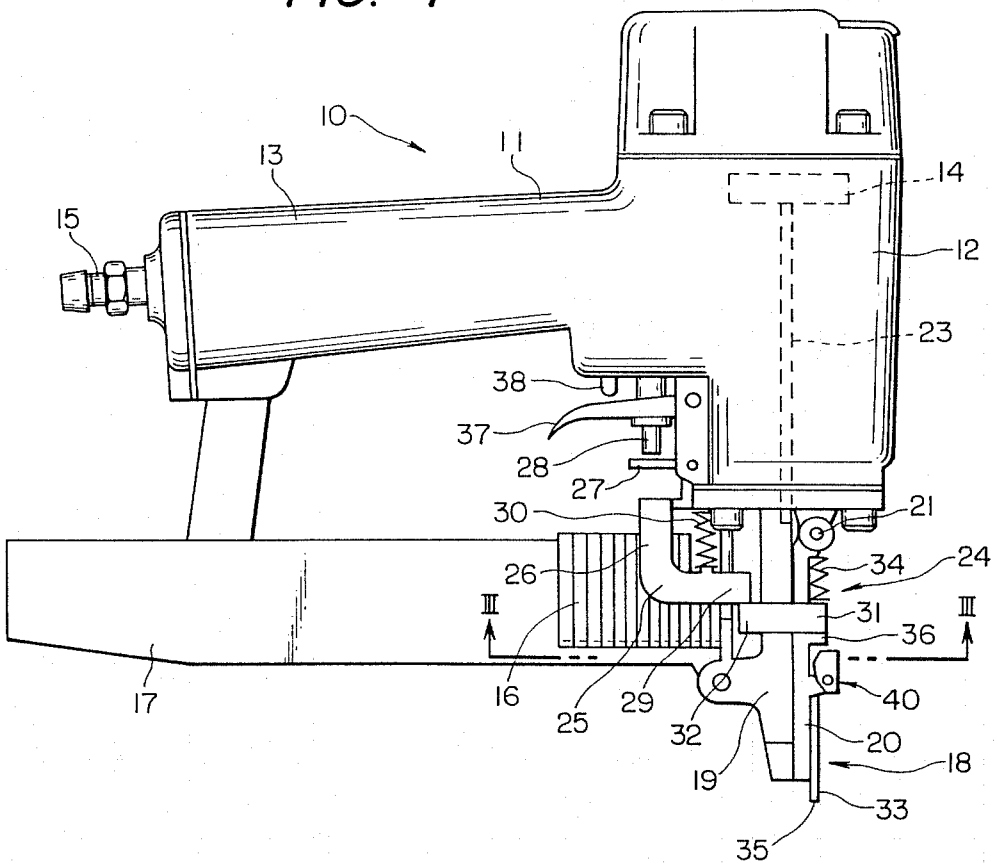
FIG. 1 is a front elevational view of a power-driven held-held fastener driving machine according to the present invention.

FIG. 1 shows a power-driven hand-held fastener driving machine 10 such as a tacker or stapling machine. The fastener driving machine 10 is pneumatically powered, but may be hydraulically or electrically driven.

Figure 3:
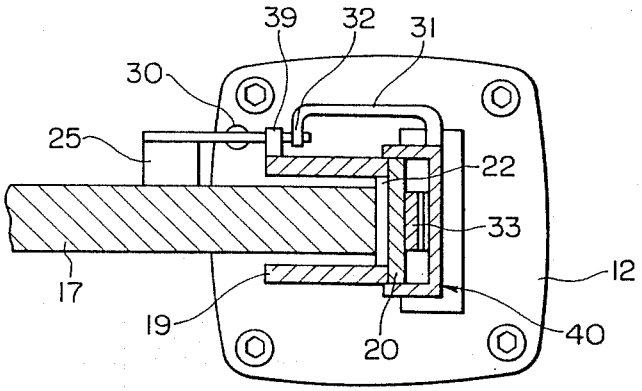
FIG. 3 is an enlarged cross-sectional view taken along line III—III of FIG. 1.
Figure 2:
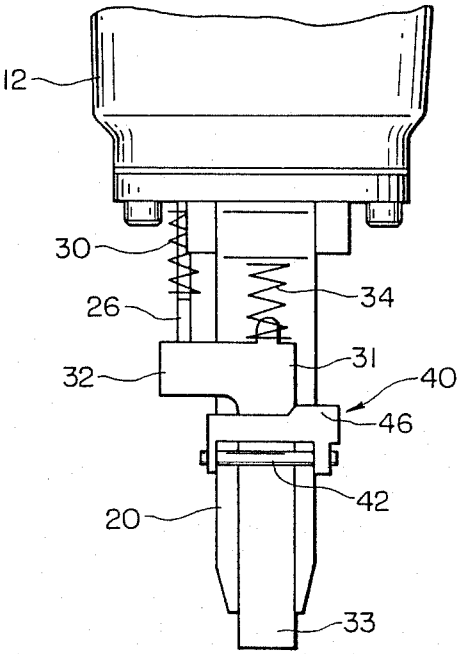
FIG. 2 is an enlarged fragmentary side elevational view of the fastener driving machine shown in FIG. 1.

The fastener driving machine 10 includes a housing 11 composed of a head 12 and a handle 13. The head 12 accommodates therein a reciprocally movable piston 14 drivable by a pneumatic pressure introduced through an inlet fitting 15 on the handle 13. A strip of U-shaped fasteners or staples 16 is housed in a magazine 17 mounted on the housing 11. A guide assembly 18 is mounted on the head 12 and includes a first guide 19 fixed to the head 12 and the magazine 17 and a second guide or nose piece 20 pivotably mounted by a pivot pin 21 on the head 12. The second guide 20 is angularly movable toward and away from the first guide 19. The first and second guides 19, 20 as they mate with each other jointly provide a drive track 22 (FIG. 3) through which a blade or plunger 23 attached to the piston 14 is reciprocally movable. The first guide 19 has an opening (not shown) through which the staples 16 are introduced one by one into the drive track 22.

A safety device, generally designated at 24, comprises an L-shaped member 25 movable toward and away from the head 12 parallel to the fixed first guide 19. The L-shaped member 25 includes a first arm 26 slidably supported on the head 12 and includes an abutment 27 disposed in confronting relation to a first switch or valve actuator 28 mounted on the head 12. The L-shaped member 25 also includes a second arm 29 integral with and extending perpendicularly from the first arm 26, the second arm 29 having an end located adjacent to the fixed first guide 19. The L-shaped member 25 is normally urged to move in a direction away from the head 12 by a compression coil spring 30 acting between the head 12 and the second arm 29. The L-shaped member 25 is stopped by a stop 39 against excessive movement biased by the spring 30. The safety device 24 also has a coacting member 31 composed of a third arm 32 extending parallel to the second arm 29 into the path of movement of the second arm 29 and a fourth arm 33 integral with the third arm 32 and slidably disposed on the second guide 20. The coacting member 31 is normally urged to move away from the head 12 by a compression coil spring 34 acting between the head 12 and the coacting member 31. When the safety device 24 is in the position of FIG. 1, the second arm 29 and the third arm 32 are held in engagement with each other. The fourth arm 33 has a distal end 35 normally projecting beyond the distal end of the second guide 20. The coacting member 31 is prevented by a stop 36 on the second guide 20 from spring-biased movement.

A trigger 37 is pivotably mounted on the head 12. When the trigger 37 is pulled by hand, it pushes a second switch or valve actuator 38. The first and second valve actutators 28, 38 are operatively coupled to first and second valves (not shown), respectively, disposed in the head 12 and connected in a pneumatic line between the inlet fitting 15 and the cylinder in which the piston 14 is disposed. Therefore, the piston 14 is actuated under the pneumatic pressure only when both the first and second actuators 28, 38 are pushed. Such a safety arrangement is well known in the art and will not be described in greater detail.

Figure 4:
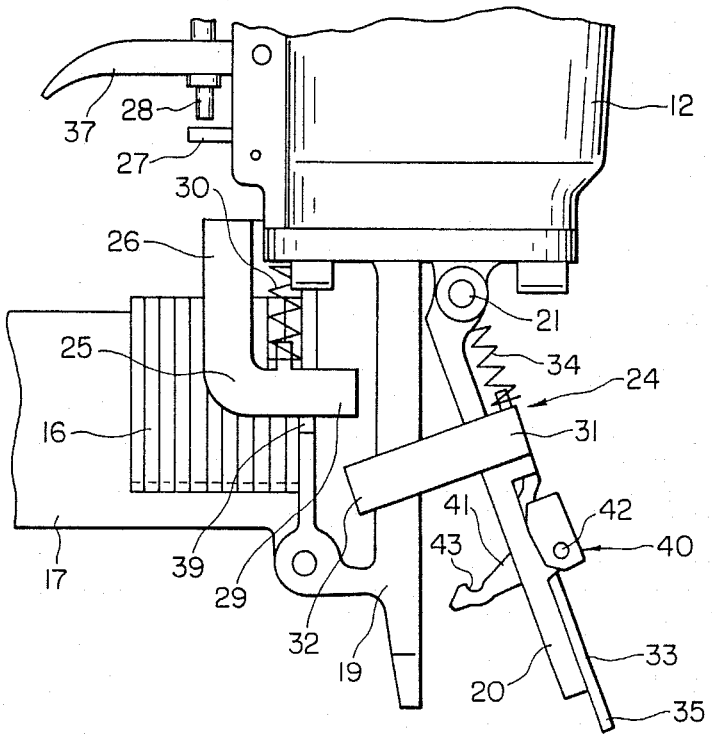
FIG. 4 is a fragmentary front elevational view of the fastener driving machine, showing a guide as opened with a safety device released.
Figure 6:
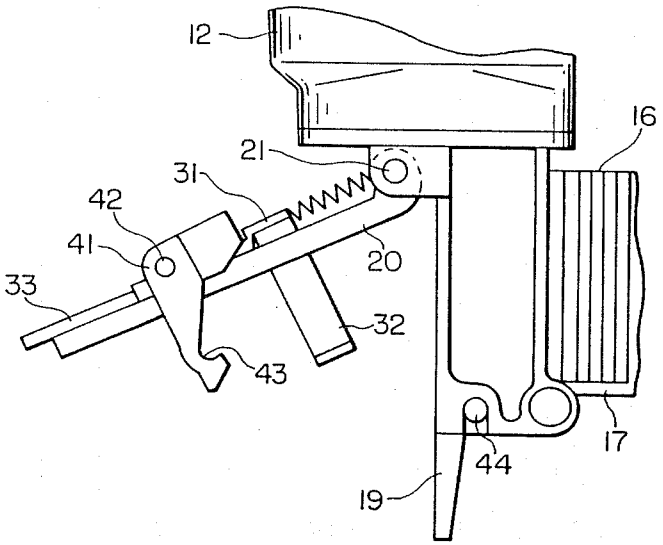
FIG. 6 is a fragmentary rear elevational view showing the guide locking device as unlocking the guide.
Figure 5:
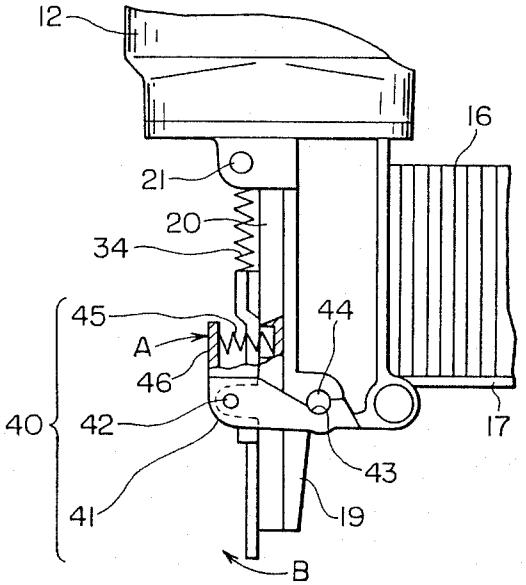
FIG. 5 is a fragmentary rear elevational view illustrating a guide locking device.

As shown in FIGS. 2, 4, 5, and 6, a guide locking device 40 comprises a latch lever 41 pivotably mounted on the second guide 20 by means of a pin 42 which extends across and over the fourth guide 33 to retain the same against dislodgment. The latch lever 41 has a semicircular recess 43 defined in a distal end portion thereof. A circular projection 44 mounted on the first guide 19 engages in the semicircular recess 43 when the second guide 20 mates with the first guide 19 as shown in FIG. 5. The latch lever 41 is normally urged to turn counterclockwise (FIG. 5) toward the projection 44 by a compression coil spring 45 acting between the second guide 20 and a rear tongue 46 of the latch lever 41, which is disposed over the second guide 20.

Operation of the fastener driving machine 10 will be described hereinbelow.

When a staple 16 is to be driven into a workpiece (not shown), the fastener driving machine 10 is carried by hand and brought toward the workpiece to press the distal end 35 of the fourth arm 33 against the workpiece. The fastener driving machine 10 is pushed against the workpiece until the coacting member 31 engages the L-shaped member 25 and causes the abutment 27 to depress the first valve actuator 28 against the bias of the springs 30, 34. The first valve (not shown) is now opened. Then, the trigger 37 is pulled to depress the second valve actuator 38 whereupon the second valve (not shown) is opend to allow a supplied pneumatic pressure to act on the piston 14, which is then moved forward to enable the plunger 23 to drive the staple 16 out of the drive track 22 into the workpiece.

In the event of a staple jam in the drive track 22 such as when driving a staple into a relatively hard workpiece or driving a wrong staple, the fastener driving machine 10 is brought away from the workpiece to allow the safety device 24 to be positioned as shown in FIG. 1 under the forces of the springs 30, 34. At this time, the first valve actuator 28 is released. Then, the rear tongue 46 of the guide locking device 40 is depressed toward the guide assembly 18 in the direction of the arrow A (FIG. 5) against the resiliency of the spring 45, whereupon the latch lever 41 disengages from the projection 44 as a result of angular movement about the pin 42. The second guide 20 is released to turn in the direction of the arrow B (FIG. 5) about the pin 21 to the position of FIGS. 4 and 6. As illustrated in FIG. 4, the coacting member 31 is now displaced away from the L-shaped member 25. Therefore, if the operator touches the coacting member 31 while removing the staple jam, the coacting member 31 will not engage the L-shaped member 25 so that the first valve actuator 28 will not be pushed by the abutment 27. Since the L-shaped member 25 is positioned away from the drive track 22, there is substantially no possibility for the operator to touch the L-shaped member 25 while the operator attempts to remove the jam. Accordingly, even when the trigger 37 happens to be actuated to depress the second valve actuator 38, the pneumatic cylinder will not be actuated, and hence the plunger 23 will not be driven.

After the jam has been eliminated, the second guide 20 is turned in a direction opposite to the direction B (FIG. 5) until the latch lever 41 is engaged by the projection 44. Once the projection 44 is seated in the recess 43, the latch lever 41 remains engaged by the projection 44 under the bias of the spring 45.

Since the second guide 20 can easily be released out of mating association with the first guide 19 to open the drive track 22 simply by unlocking the guide locking device 40, any staple jam can easily be removed from the drive track 22.

Although a certain preferred embodiment of the present invention has been shown and described in detail, it should be understood that various changes and modifications may be made therein without departing from the scope of the appended claims.

What is claimed is:

1. A power-driven fastener driving machine for driving fasteners into a workpiece, comprising:

(a) a housing including a reciprocally movable blade;

(b) switch means mounted on said housing for actuating said reciprocally movable blade;

(c) a guide assembly mounted on said housing and composed of a first guide fixed to said housing and a second guide pivotally mounted on said housing, said second guide being movable between a first position in which said first and second guides mate with each other to define a drive track through which said blade is reciprocally movable and a second position in which said second guide is angularly spaced from said first guide to open said drive track;

(d) a magazine mounted on said housing and said guide asembly for feeding fasteners one at a time into said drive track; and (e) a safety device composed of first and second separate members, said first member being movably mounted on said housing for engaging said switch means, a first spring acting between said housing and said first member for normally urging said first member away from said switch means, the second member movably mounted on said second guide and engageable with said first member when said second guide is in said first position, and a second spring acting between said housing and said second member for normally urging said second member to keep a distal end thereof projecting beyond said second guide, whereby when said distal end of said second member is pressed against the workpiece at the time said second guide is in said first position, said second member engages said first member to cause said first member to actuate said switch means, and when said second guide is in said second position, said second member is kept out of engagement with said first member.

2. A power-driven fastener driving machine according to claim 1, wherein said first member has a substantially L shape composed of a first arm including an abutment in confronting relation to said switch means and a second arm extending substantially perpendicularly from said first arm, said first spring acting between said housing and said second arm.

3. A power-driven fastener driving machine according to claim 2, wherein said second member is composed of a third arm extending substantially parallel to and engageable with said second arm and a fourth arm extending from said third arm and slidably mounted on said second guide, said fourth arm having said distal end.

4. A power-driven fastener driving machine according to claim 1, further including a guide locking device mounted on said second guide and comprising a pivotable latch lever for lockingly engaging said first guide to maintain said second guide in said first position.

5. A power-driven fastener driving machine according to claim 4, said guide locking device includes a pin by which said latch lever is pivotably mounted on said second guide, said first guide having a projection, said latch lever having a recess receptive of said projection and a tongue disposed over said second guide, and a spring acting between said tongue and said second guide for normally urging said latch lever in a direction to engage said projection when said second guide is in said first position.

* * * * *